US006443170B1

(12) United States Patent
Vansant et al.

(10) Patent No.: US 6,443,170 B1
(45) Date of Patent: Sep. 3, 2002

(54) CLEANING APPARATUS FOR REMOVING RESIDUES

(75) Inventors: Frans Vansant, Kalmthout; Jozef de Hert, Antwerpen, both of (BE); Dieter Köffer, Birkenau (DE); Gerhard Theis, Maxdorf (DE); Winfried Terjung, Dinslaken (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/451,858

(22) Filed: Dec. 1, 1999

(30) Foreign Application Priority Data

Dec. 3, 1998 (DE) ..... 198 55 910

(51) Int. Cl.[7] ..... B08B 9/08
(52) U.S. Cl. ..... 134/166 R
(58) Field of Search ..... 134/166 R, 167 R, 134/168 R, 169 R

(56) References Cited

U.S. PATENT DOCUMENTS 3,046,163 A * 7/1962 Kearney et al. ..... 134/168 R
3,185,661 A * 5/1965 Hubby ..... 134/166 R
4,770,196 A * 9/1988 Osswald ..... 134/166 R
5,061,348 A 10/1991 McCormick et al. ..... 202/154
5,330,624 A 7/1994 Ebert ..... 203/4
5,603,826 A * 2/1997 Welch ..... 134/169 R
5,810,059 A * 9/1998 Rutter et al. ..... 134/166 R

* cited by examiner

*Primary Examiner*—Philip Coe
(74) *Attorney, Agent, or Firm*—Keil & Weinkauf

(57) ABSTRACT

A cleaning apparatus for removing residues from the bottoms outflow of an evaporation apparatus which produces tops product and bottoms product and is equipped with an outflow, comprising:

a) an outflow vessel (7),
b) a collection vessel (8),
c) an outflow valve, (10),
d) a cleaning water valve (11),
e) a vessel outflow valve (12),
f) a cleaning outflow valve (13),
g) a vent valve (14),
h) a line (17) leading from the bottom to the outflow valve (10),
i) a cleaning agent introduction tube (3),
j) an outflow line device (6, 16) and connection lines between the devices a) to j).

The cleaning apparatus can be used in the workup of salt-containing solutions by distillation.

10 Claims, 1 Drawing Sheet

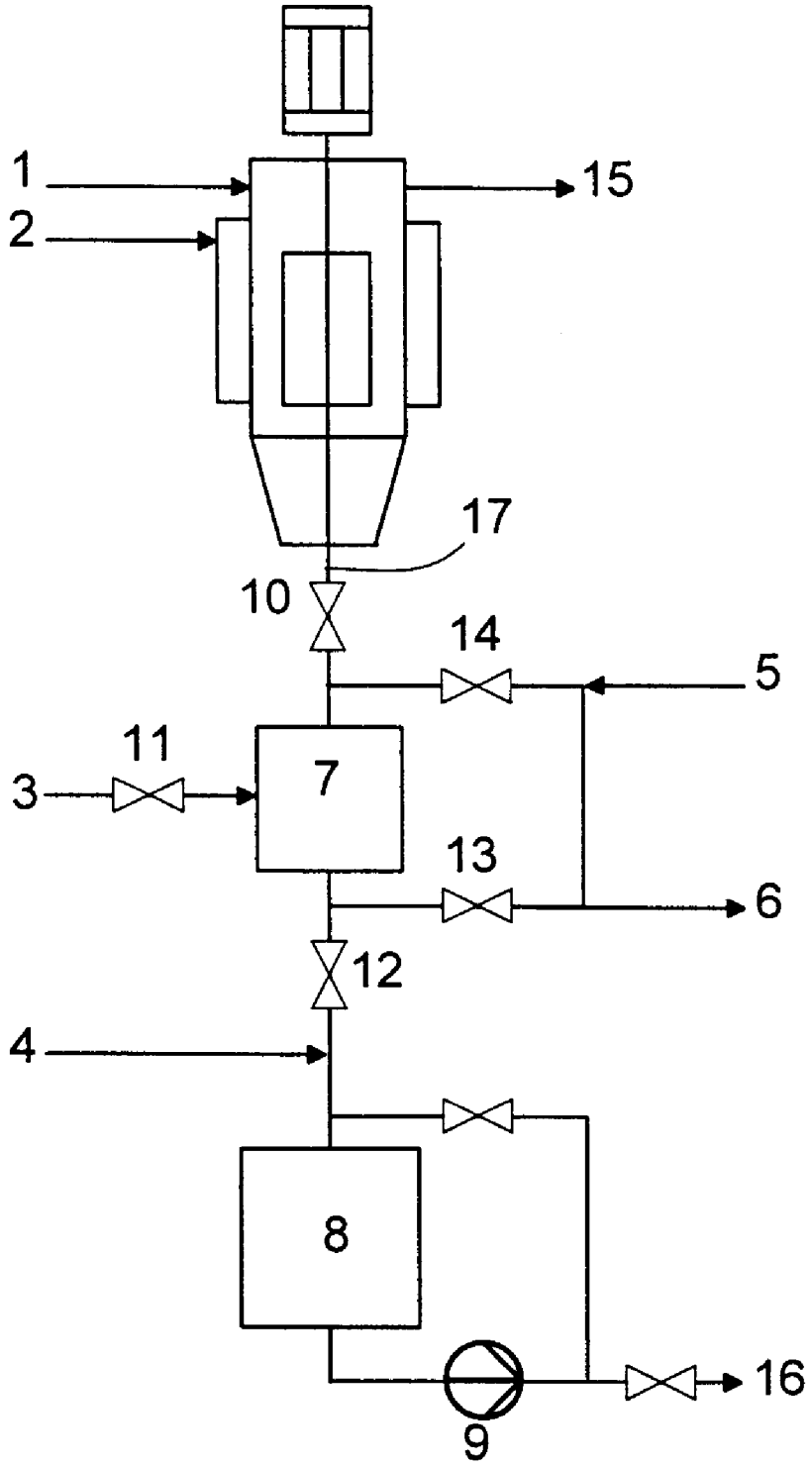
1
2
15
17
10
14
5
11
3
7
13
6
12
4
8
16
9

CLEANING APPARATUS FOR REMOVING RESIDUES

The invention relates to a cleaning apparatus for removing residues from the bottoms outflow of an evaporation apparatus and its use for the workup of salt-containing solutions by distillation.

Thin-film evaporation is used for continuous distillation, especially for vaporizing heat-sensitive substances from high-boiling residues and for concentrating heat-labile substances. In this case the liquid is distributed by trickling (falling-film evaporator), effect of centrifugal force (special embodiment of a rotary evaporator), specially constructed scrapers (filmtruders) or other methods to form thin films (the order of magnitude of the film thickness is generally approximately 0.1 mm) onto the (generally) heated surfaces. Thin liquid films enable rapid vaporization so that the components present are only exposed briefly to the (generally) relatively high temperatures in the evaporator. The residence time, the temperature and the pressure (vacuum) are designed in accordance with the respective separation objective. To preserve the substances in question, temperatures as low as possible and residence times as short as possible are to be preferred here. In addition to evaporation apparatuses which are already termed thin-film evaporators in general technical language, according to the invention all other evaporation apparatuses which operate according to the abovementioned principle are thin-film evaporators.

A typical thin-film evaporator has a vertically upright externally heated tube on the inner surface of which the product to be vaporized is spread as a thin film by a rotor. The product enters into the evaporator above the heating zone and owing to the mechanical distribution by the rotor flows as a liquid film over the heated surface. The low-boiling components vaporize while the residue flows off downwards. The vapors flow through a demister which is located in the top of the evaporator and condense in a separately disposed condenser. For the mechanical liquid distribution, a rotor having pendulous metal scraper blades is installed. In operation, the centrifugal force presses the scrapper blades against the evaporator wall which causes a uniform product distribution and an intensive liquid mixing of the liquid film.

However, a particular problem frequently occurs when liquids are vaporized which comprise dissolved residues, for example dissolved salts:

The reason is that these residues can precipitate in the bottoms. These are residues which generally were present as dissolved components in the liquid before the evaporation and precipitate as solids after evaporation of solvent. An example which can be cited is the evaporation of salt solutions, where salt, after the evaporation of solvent, arises as solid residue in the bottoms of the evaporation apparatus. In addition to such salts, soluble residues can in principle be all solids which can be removed by a cleaning agent—generally dissolved in a solvent.

The thin-film evaporator described at the outset is intended not only to ensure the complete evaporation of evaporable components from a residue-containing—for example salt-containing—solution, but also to provide the residues as a pumpable mass which can be removed from the bottoms. However, in the case of a thin-film evaporator which operates according to the above described principle, this is not the case, since residues, for example salts, can precipitate in the region of the bottoms outflow and form encrustations, so that the bottoms can no longer be discharged without problem on account of blockages. The bottoms outflow is generally the tapering part—usually the part tapering to a tube—of the bottom, through which the bottoms product is passed on removal from the evaporation apparatus. The continuous operation of the thin-film evaporator must be stopped on the occurrence of such blockages, so that corresponding cleaning work can be initiated. The same problems also frequently occur when other evaporation apparatuses are used, for example distillation columns.

It is an object of the present invention to provide an apparatus with which liquids comprising dissolved residues can be separated in an evaporation apparatus without the bottoms outflow of the evaporation apparatus plugging owing to the residues. No cleaning work is to be necessary here which would interrupt the continuous evaporation. Not only the bottoms product but also the tops product of the corresponding evaporation process is to be obtained in as gentle a manner as possible. The apparatus is to operate effectively and inexpensively.

We have found that this object is achieved by a cleaning apparatus for removing residues from the bottoms outflow of an evaporation apparatus which generates a tops product and bottoms product and is equipped with a bottoms outflow, comprising:

a) an outflow vessel, b) a collection vessel, c) an outflow valve, d) a cleaning water valve, e) a vessel outflow valve, f) a cleaning outflow valve, g) a vent valve, h) a line leading from the bottom to the outflow valve, i) a cleaning agent introduction tube, j) an outflow line device and connection lines between the devices a) to j).

In a preferred embodiment, the outflow vessel is directly connected via connection lines to the outflow valve, the cleaning water valve, the vessel outflow valve, the cleaning outflow valve and the vent valve.

The outflow vessel is generally disposed above the collection vessel and below the bottom.

The cleaning outflow line can open into the bottoms outflow line, so that the outflow line device has a shared exit for cleaning agent and bottoms product. However, preferably, the outflow line device is constructed in the form of two lines, a cleaning outflow line and a bottoms outflow line, so that bottoms and cleaning agent are removed separately through different outlets.

Usually the evaporation device is evacuated, since, generally, a mild evaporation is usually only possible under reduced pressure (then taking place under lower temperatures). During the removal of bottoms product from the evaporation apparatus, therefore, air could penetrate into the evaporation apparatus via the bottoms outflow. However, according to the invention the ingress of air into the evaporation apparatus can be prevented:

In a preferred embodiment of the invention one or more inert gas introduction tubes open into the outflow vessel and/or into the collection vessel and/or into connection lines between the devices a) to j). These precautions are expedient therefore in particular to prevent the ingress of air (and thus also of oxygen) into the apparatus via introduction of protective gas, for example nitrogen. In this manner oxidation-sensitive substances present in the tops product or bottoms product can be protected.

The collection vessel is preferably connected to a pump. This can circulate the contents of the collection vessel, so that they remain homogeneous and the deposition of residues is avoided.

In principle all types of evaporation apparatuses can be used which produce tops product and bottoms product. Not only tops product but also bottoms product are generally mixtures. However, the tops product especially can also consist of a single substance. In a preferred embodiment the evaporation apparatus is a thin-film evaporator.

The cleaning apparatus of the invention is used in particular for the workup of salt-containing solutions by distillation. These are generally solutions which, in addition to the dissolved salts, also contain products of value (frequently products of value which are sensitive to oxidation). Usually, still other workup steps are necessary in order to obtain pure products of value.

The bottoms outflow of the evaporation apparatus is cleaned at intervals using the cleaning apparatus of the invention. Generally, a cleaning agent is used in which the residues present are dissolved. The cleaning apparatus of the invention therefore preferably serves for removing soluble residues. However, mechanical cleaning effects can also be effective, since the cleaning agent can impact the corresponding residues at a certain velocity. It is thus not absolutely necessary that the residues be completely soluble in the cleaning agent.

Especially when salts block the bottoms outflow it is advisable to use water as cleaning agent. Since, in some cases in practice cleaning agent can pass into the tops product of the evaporation apparatus, it is advisable in these cases to use a cleaning agent which does not have a lasting adverse effect on further workup of the tops product.

In the event of blockage with salts, the bottoms outflow of the evaporation apparatus can, after cleaning and mixing with the cleaning agent (water), be pumped off and stored. Depending on the properties of the resultant mixture, this can be burnt, for example in a residue incinerator, disposed of in a biological treatment plant or (if products of value are still present) be worked up further.

The mode of functioning of the apparatus according to the invention is to be described hereinafter with reference to a preferred embodiment, for the example of a salt-precipitating thin-film evaporator.

In the accompanying drawing, FIG. 1 shows a thin-film evaporator having a cleaning apparatus according to the invention. This cleaning apparatus has an outflow line device (6, 16) which is designed in the form of two lines, one cleaning outflow line (6) and one bottoms outflow line (16).

To prevent the bottoms outflow being plugged by salts crystallizing out, this outflow is cleaned at intervals. For this purpose the bottoms product is first collected in an outflow vessel 7 which gradually fills up. When a certain filling height is reached, the outflow valve 10 is closed and the vacuum in the outflow vessel 7 is abolished by opening the vessel outflow valve 12 to the collection vessel 8 (the collection vessel 8 is under atmospheric pressure or slight superatmospheric pressure). The vent valve 14 is then opened and the contents of the outflow vessel 7 flow out into the collection vessel 8. The contents of the collection vessel 8 are expediently circulated using a pump 9 in order to keep them homogeneous and to prevent possible salt deposition. The contents are removed continuously or batchwise for interim storage and further utilization, for example for incineration.

The outflow vessel 7 is then cleaned. Expediently, water is used to for this purpose, preferably warm water or steam condensate. To initiate the cleaning operation, the vessel outflow valve 12 is closed and the cleaning outflow valve 13 and the cleaning water valve 11 are opened. The warm cleaning water which is fed through the cleaning agent introduction tube 3 then flows through the outflow vessel 7 and in this manner removes the salt deposits. The cleaning outflow can (depending on constituents present) be fed, for example, to a biological purification plant. Cleaning duration and water flow rate are set as required so that the amount of water needed is as low as possible. Generally (depending on loading of the evaporation apparatus and salt content) a cleaning time of from 1 to 2 minutes is sufficient. To prevent blockages in the outflow line to the collection vessel 8, this line is cleaned at intervals by opening the vessel outflow valve 12 (instead of the cleaning outflow valve 13). Preferably this is performed every 10 to 20 cleaning passes.

After expiry of a precleaning time, the cleaning outflow valve 13 is closed and in further course of the cleaning phase the water is flushed via the outflow vessel 7 and the outflow line through the vent line and through the vent valve 14. The cleaning water valve 11 is then closed and, in order to empty the outflow vessel, the cleaning outflow valve 13 is opened. Residual cleaning water is drained off by opening the vessel outflow valve 12. All valves are then closed again.

By opening the outflow valve 10, the outflow vessel is evacuated again and the outflow cycle can begin again.

In order to prevent the ingress of air, the outflow lines to the collection vessel and to the cleaning agent outflow are provided with inert gas purges (generally nitrogen purging). Inert gas is fed via the introduction tubes (4; 5).

An automated sequence control of these outflow and cleaning operations is advantageous.

LIST OF DESIGNATIONS

1. Feed into the evaporation apparatus
2. Steam stream for heating the jacket of the evaporator apparatus
3. Cleaning agent introduction tube
4. Inert gas introduction tube
5. Inert gas introduction tube
6. Cleaning outflow line
7. Outflow vessel
8. Collection vessel
9. Pump
10. Outflow valve
11. Cleaning water valve
12. Vessel outflow valve
13. Cleaning outflow valve
14. Vent valve
15. Tops stream of the evaporation apparatus
16. Bottoms outflow line
17. Line leading from the bottom to the outflow valve

We claim:

1. A cleaning apparatus for removing residues from the bottoms outflow of an evaporation apparatus which generates a tops product and bottoms product and is equipped with a bottoms outflow, comprising:

a) an outflow valve;

b) a line leading from the bottom of said evaporation apparatus to the outflow valve a);

c) an outflow vessel wherein said bottoms product of said evaporation apparatus is collected;

d) a vessel outflow valve;

e) a vent valve;

f) a collection vessel, wherein the contents of said outflow vessel c) flow after opening of the vessel outflow valve d) and the vent valve e);

g) a cleaning agent introduction tube, through which a cleaning agent is fed into said outflow vessel c);

h) a cleaning water valve;

i) a cleaning outflow valve, which is opened to empty the outflow vessel c) after expiry of a precleaning time;

j) an outflow line device having a shared exit or separate exits for the bottoms product and the cleaning agent; and connection lines between the devices a) to j).

2. A cleaning apparatus as claimed in claim 1, wherein the outflow vessel c) is directly connected via connection lines to the outflow valve a), the cleaning water valve h), the vessel outflow valve d), the cleaning outflow valve i) and the vent valve e).

3. A cleaning apparatus as claimed in claim 1, wherein the outflow vessel c) is disposed above the collection vessel f) and below the bottom of said evaporation apparatus.

4. A cleaning apparatus as claimed in claim 1, wherein the outflow line device j) is constructed in the form of two lines, a cleaning outflow line and a bottoms outflow line.

5. A cleaning apparatus as claimed in claim 1, wherein one or more inert gas introduction tubes open into the outflow vessel c) and/or into the collection vessel f) and/or into connection lines between the devices a) to j).

6. A cleaning apparatus as claimed in claim 1, wherein the collection vessel f) is connected to a pump.

7. A cleaning apparatus as claimed in claim 1, wherein water is introduced through the cleaning agent introduction tube g).

8. An evaporation apparatus producing tops product and bottoms product which is equipped with a cleaning apparatus for removing residues from its bottoms outflow, said cleaning apparatus comprising:

a) an outflow valve;

b) a line leading from the bottom of said evaporation apparatus to the outflow valve a);

c) an outflow vessel wherein said bottoms product of said evaporation apparatus is collected;

d) a vessel outflow valve;

e) a vent valve;

f) a collection vessel, wherein the contents of said outflow vessel c) flow after opening of the vessel outflow valve d) and the vent valve e);

g) a cleaning agent introduction tube, through which a cleaning agent is fed into said outflow vessel c);

h) a cleaning water valve;

i) a cleaning outflow valve, which is opened to empty the outflow vessel c) after expiry of a precleaning time;

j) an outflow line device having a shared exit or separate exits for the bottoms product and the cleaning agent; and connection lines between the devices a) to j).

9. An evaporation apparatus as claimed in claim 1, wherein the evaporation apparatus is a thin-film evaporator.

10. An evaporation apparatus as claimed in claim 1, wherein the evaporation apparatus is evacuated.

* * * * *